United States Patent [19]

Noda et al.

[11] Patent Number: 4,875,522

[45] Date of Patent: Oct. 24, 1989

[54] HEAT PIPE HEAT EXCHANGER

[75] Inventors: Hajime Noda, Yokohama; Kuniyoshi Sato, Tokyo; Junji Sotani, Yokohama, all of Japan

[73] Assignee: Furukawa Electric Co., Ltd., Tokyo, Japan

[21] Appl. No.: 340,059

[22] Filed: Apr. 18, 1989

[30] Foreign Application Priority Data

Apr. 20, 1988 [JP] Japan ..... 63-97561

[51] Int. Cl.[4] ..... F28D 15/02; F28G 13/00

[52] U.S. Cl. ..... 165/104.14; 165/95; 165/184

[58] Field of Search ..... 165/104.14, 95, 184

[56] References Cited

U.S. PATENT DOCUMENTS 4,303,122 12/1981 Powell ..... 165/95

4,766,952 8/1988 Onodera ..... 165/95

*Primary Examiner*—Albert W. Davis, Jr.

*Attorney, Agent, or Firm*—Notaro & Michalos P.C.

[57] ABSTRACT

The present invention proposes a heat pipe heat exchanger comprising a hot gas flow duct, a cold gas flow duct and a plurality of heat pipes each with spiral fins around thereof that are installed horizontally a little slanted so that an end of each heat pipe in said hot gas flow duct becomes a little lower than the other end, and that said spiral fins are winding clockwise around some of the heat pipes and counter-clockwise around some other heat pipes. This device can prevent a bias flow of the steel balls at the so-called shot cleaning process performed for elimination of dust deposited on the heat pipes by arranging a layout of the two kinds of heat pipes, namely the heat pipes with clockwise winding fins around thereof and the heat pipes with counter-clockwise winding fins, and if required, can even control the flow of the steel balls so that they gather onto the area where more dust is deposited.

7 Claims, 5 Drawing Sheets

HEAT PIPE HEAT EXCHANGER

BACKGROUND OF THE INVENTION

1. Field of the Invention

This invention relates to a heat pipe heat exchanger that recovers the heat of hot gas exhausted from the devices such as thermal power plants into the lower thermal gas.

2. Description of the Prior Art

Because of the bulkiness of exchangers both in terms of its manufacturing process and material, it is prevailing for the heat pipes of this type of heat pipe heat exchangers, to have spiral fins. The heat pipes with spiral fins ar installed in many rows in a casing that is divided into two sections by a vertical divider plate, namely into the hot gas flow duct and the cold gas flow duct. Through the divider plate penetrates each heat pipe so that an end of each pipe is exposed to the hot gas flow while the other end to the cold gas flow. The heat pipes in the hot gas flow duct are installed horizontally a little slanted so that they can recover and transfer the heat of the exhausted hot gas that pass through the hot gas flow duct to the cold gas that pass through the cold gas flow duct.

Generally, the winding direction of the spiral fins are decided in accordance with the specifications of high frequency welding machine manufacturing the fins. As the most of the present day's welding machines are designed to weld the fins clockwise, most of the heat pipes of this type of heat exchangers are with fins winding clockwise. Further, as the winding direction of the fins does not matter the effectiveness of the heat pipes itself with regard to the heat exchange capacity, no attention was paid to the winding direction of the fins used for this type of heat exchangers.

As the dust present in the exhausted hot ga that deposit on the heat pipes with spiral fins may cause impairment of the thermal efficiency of the heat exchanger, so called shot cleaning process has been recommended and employed prevailingly, which eliminates the dust deposited on the heat pipes with spiral fins by means of a number of small steel balls falling on and colliding with the bank of heat pipes.

The reason why the spiral fins heat pipes are positioned a little slanted horizontally so as to have an end of each pipe in the hot gas flow duct becomes lower than the other end is to accelerate the flow-back of the heat medium in the heat pipes. In the conventional type of heat exchangers, as mentioned above, no attention was paid to the winding direction of the spiral fins provided around the heat pipes. For example, as viewed in FIG. 5, which is a partial sectional view of a conventional heat pipe heat exchanger, each heat pipe 1 is slightly slanted so that this side in FIG. 5 of the heat pipes comes lower and the spiral fins 11 are slightly facing upward and therefore, more steel balls are inclined to bounce to the left direction in FIG. 5 colliding with the spiral fins 11, thus, as shown by arrows in FIG. 5, more steel balls fall down to the same direction as the fins' slope face and therefore, the lower the rows, the more balls are gathered basically to the left side in FIG. 5 resulting in an insufficient cleaning in the below right area in FIG. 5 of the heat pipes. This tendency increases all the more the larger in scale the heat exchangers are.

SUMMARY OF THE INVENTION

It is the primary object of this invention to provide a heat pipe heat exchanger that can control an even dispersion of steel balls in the shot cleaning process and at the same time can make a cleaning of the tube surface of heat pipes as overall and evenly a possible all through the device.

The present invention provides for a heat pipe heat exchanger characterized in that it contains a hot gas flow duct, a cold gas flow duct and heat pipes with spiral fins, the winding direction of which are clockwise around some of the heat pipes and counter-clockwise around some others, that are installed in the ducts in the hot gas flow duct becomes lower than the other end of the heat pipes. Further, the heat pipes with the spiral fins winding clockwise and those with the fins winding counter-clockwise are preferred to be arranged alternately in the hot gas flow duct. Although the heat pipes with clockwise winding fins and those with counter-clockwise winding fins are not necessarily positioned in an alternate layout in a strict sense, it is preferred to arrange, for example, the heat pipes with clockwise winding fins and those with counter-clockwise winding fins in a staggered layout either vertically and/or horizontally so that the fins' slopes are substantially evenly mixed throughout the device allowing to attain a better overall cleaning of the heat pipes.

As more deposion of dust are present on the heat pipes near the inlet of the exhausted hot gas flow, especially these just below the inlet, it is preferred to arrange the heat pipes with spiral fins in such the same winding direction as to have, when scattered from the top of the pipe bundle, more steel balls fall on these pipes in the inlet area, especially these just below the inlet, while in other area the rows of heat pipes with spiral fins winding differently are to be arranged in a staggered layout.

Generally speaking, in terms of corrosion resistance as well as for economy's sake, the carbon steel is more appropriate as material of tubes themselves of heat pipes that are to be exposed to a relatively hotter exhausted gas, while the stainless steel is better suited for the tubes exposed to the less hot exhausted gas. Therefore, carbon steel is preferred as tube material of the heat pipes that are installed in a position along the upper stream of the exhausted hot gas where a relatively hotter gas flows, while stainless steel is preferred for the tubes that are positioned along the downstream that are exposed to a relatively less hot gas flow. As for the spiral fins, stainless steel is stronger in collision resistance of the small steel balls than carbon steel in a hot atmosphere. Therefore, stainless steel is used as fin material of the heat pipes that are exposed to a relatively hotter exhausted gas whether along the upper stream or downstream, and carbon steel is used as fin material of the heat pipes that are positioned along the upper stream.

By means of the heat pipes with spiral fins that are arranged in an alternate or staggered layout as a mentioned above, the heat pipe heat exchanger of the present invention can enjoy less bias flow or gathering of steel balls at the shot cleaning process.

By arranging some heat pipes with spiral fins which are winding in one direction and some others with spiral fins winding in another direction in an evenly alternate layout, for example, by hiding the heat pipes with clockwise winding fins and those with counter-clockwise fins in a staggered layout both vertically and horizontally, or having those with clockwise winding fins in odd numbered rows and those with counter-clockwise fins in even numbered rows or vice versa, much less bias gathering in the falling flow of the small steel balls are attained in their scattering.

Further, by having near &:he inlet along the exhausted hot gas flow a few rows of heat pipes with spiral fins winding in one direction so as to incline to make flow the small steel balls toward the heat pipes near the inlet, while for the rest of rows arranging the heat pipes with winding fins in two directions in an alternate layout, more steel balls collide with the surface of the heat pipes where more dust is deposited and thus better cleaning effect can be attained overall.

DESCRIPTION OF THE PREFERRED EMBODIMENT

Figure 1:
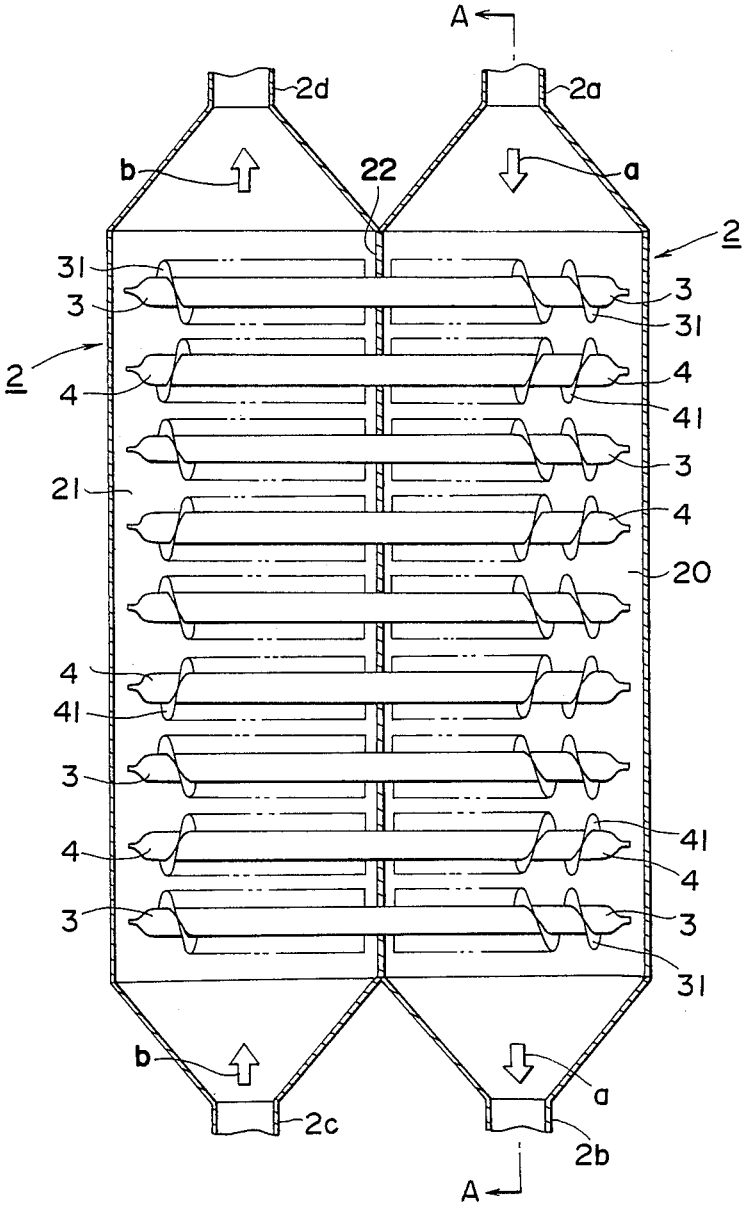
FIG. 1 is a longitudinal vertical sectional view disclosing an embodiment of the present invention heat pipe heat exchanger.
Figure 2:
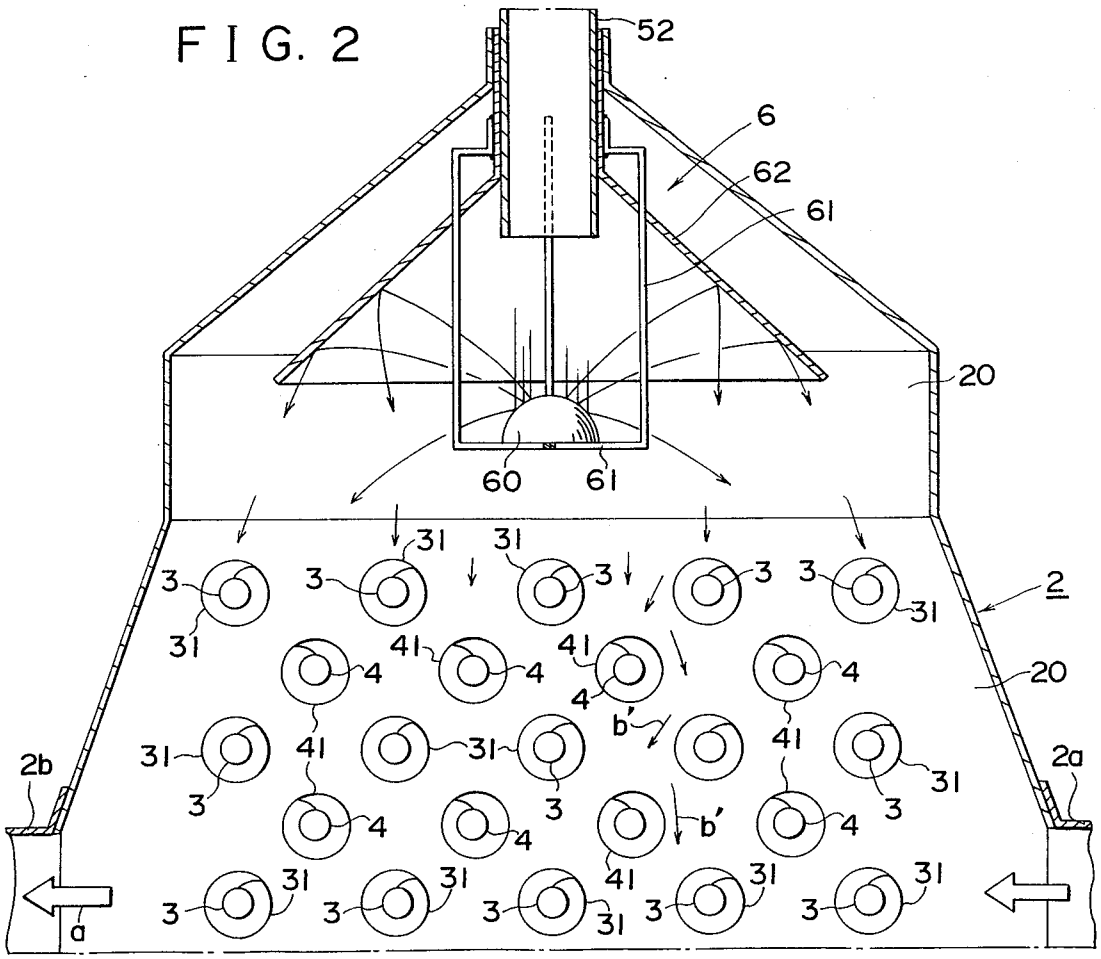
FIG. 2 is a partial sectional view crossed at A—A of FIG. 1.
Figure 3:
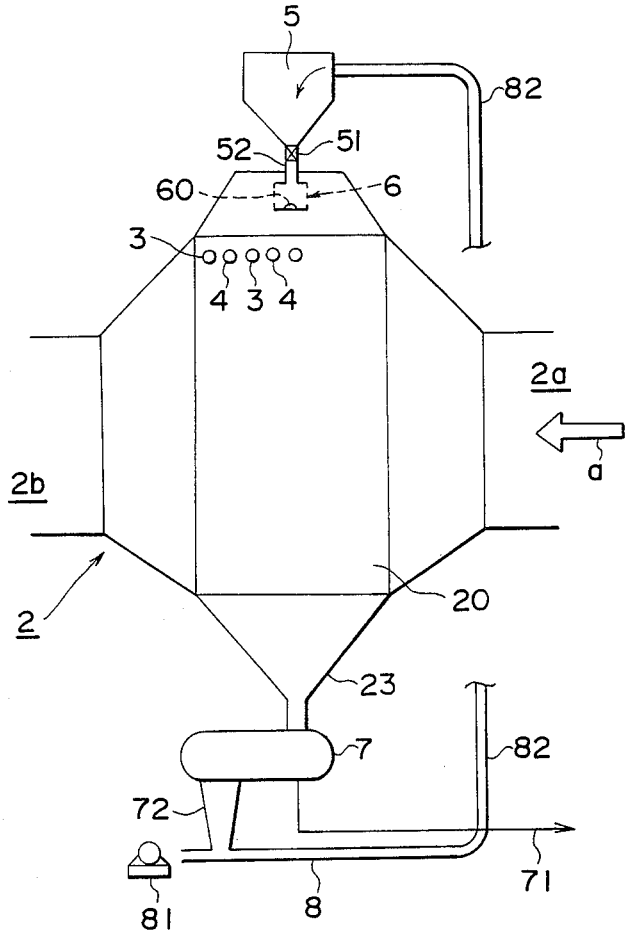
FIG. 3 is a plane view disclosing the entire layout of the present invention heat pipe heat exchanger.

FIG. 1 to FIG. 3 show an embodiment of a heat pipe heat exchanger of the present invention.

A casing 2 made of corrosion-resistant material is divided by a sealing divider plate 22 into a hot gas flow duct 20 and a cold gas flow duct 21, and a hot gas is designed to flow from the inlet 2*a* to the outlet 2*b* through the hot gas flow duct 20 (as led by the arrow a, while a clean cold gas is designed to flow from the inlet 2*c* to the outlet 2*d* through the cold gas flow duct 21 (as led by the arrow b).

Within the casing 2, heat pipes 3 with clockwise winding spiral fins 31 and heat pipes 4 with counter-clockwise winding spiral fins 41 that both penetrate the sealing divider plate 22 are arranged alternately with every end of the heat pipes in the hot gas flow duct 20 slanting a little downward so that the heat of the exhausted hot gas which flows through the hot ga flow duct 20 is recovered into the cold gas which flows through the cold gas flow duct 21 by means of a heat medium enclosed within the respective heat pipes 3 and 4.

In the present embodiment of the invention, the heat pipes 3 with clockwise winding fins 31 are installed in odd numbered rows while the heat pipes 4 with counter-clockwise winding fins 41 are installed in even numbered rows and these rows of the heat pipes 4 and heat pipes 3 are arranged alternately.

In consideration of corrosion resistance, endurance and economy of the installation site and environment, material of the tubes and fins of the heat pipes 3 and 4 are carefully selected; these selected for the present embodiment are shown in Table I.

TABLE I

| Flow Direction of Exhausted Hot Gas | | Material of Tubes and Fins: Hot Gas Flow Duct | Material of Tubes and Fins: Cold Gas Flow Duct |
|---|---|---|---|
| Upper | Fin: | Stainless Steel | Carbon Steel |
| Stream: | Tube: | Carbon Steel | Carbon Steel |
| Down- | Fin: | Stainless Steel | Stainless Steel |
| stream: | Tube: | Stainless Steel | Stainless Steel |

FIG. 3 shows an overall view of the heat pipe heat exchanger of the present invention with an overall background view of a treating system of the exhausted hot gas. The casing 2 is fixed on a platform [not shown) over which a storage tank 5 of the small steel balls i provided on the top of the hot gas flow duct 20. When a valve 51 equipped at the bottom of the storage tank 5 is opened, the steel balls in the storage tank 5 start flowing down through a neck 52 and then scattered by a disperser 6 falling on the heat pipes 3 and 4 installed in the hot gas flow duct 20, thus scraping off and carrying down the dust deposited on the heat pipes 3 and 4 the steel balls together with the dust flow down into a dust separator 7. The dust is separated from the steel balls in the dust separator 7 and discharged itself out through a dust extract line 71. While the steel balls after separated from the dust in the dust separator 7 are collected into a hopper 72 and transferred into a delivery line 8 and travel to the storage tank 5 through a lifting line 82 by the pneumatic conveying mechanism with the gas from the blower 81.

The disperser 6 in the present embodiment, as shown in FIG. 2, is composed of a scatteror 60 made of steel into a hemispherical shape that is supported by a frame 61 below the edge of a supplier 52 projecting from the casing 2 into the hot gas flow duct 20 and an auxiliary scatteror 62 made into an umbrella shape over the scatteror 60, so that the steel balls falling from the supplier 52 onto the scatteror 60 partially keep on falling directly down onto the bundles of the heat pipes, while the rest collide up against the auxiliary scatteror 62, thus a more even dispersement of the steel balls is attained.

As the heat pipe heat exchanger of said embodiment as shown in FIG. 2 has the heat pipes 3 with the clockwise winding fins 31 and the heat pipes 4 with the counter-clockwise winding fins 41 arranged in an alternate layout, the steel balls that collide with the clockwise winding fins 31 of the heat pipes 3 being present in odd numbered rows are inclined to bounce more to the left direction in FIG. 2 and then more to the right side upon colliding with the counter-clockwise winding fins 41 of the heat pipes 4 being present in even numbered rows, thus the steel balls are likely to be dispersed evenly and fall to every direction without any bias gathering of balls (as shown by an arrow b') resulting in an overall and evenly cleaned condition. In case of arranging the heat pipes in odd numbered rows and those in even numbered rows on the equal level and/or the same height, it is preferred to have the heat pipes 3 and 4 with spiral fins winding in a different direction to one another alternately vertically and horizontally.

Figure 4:
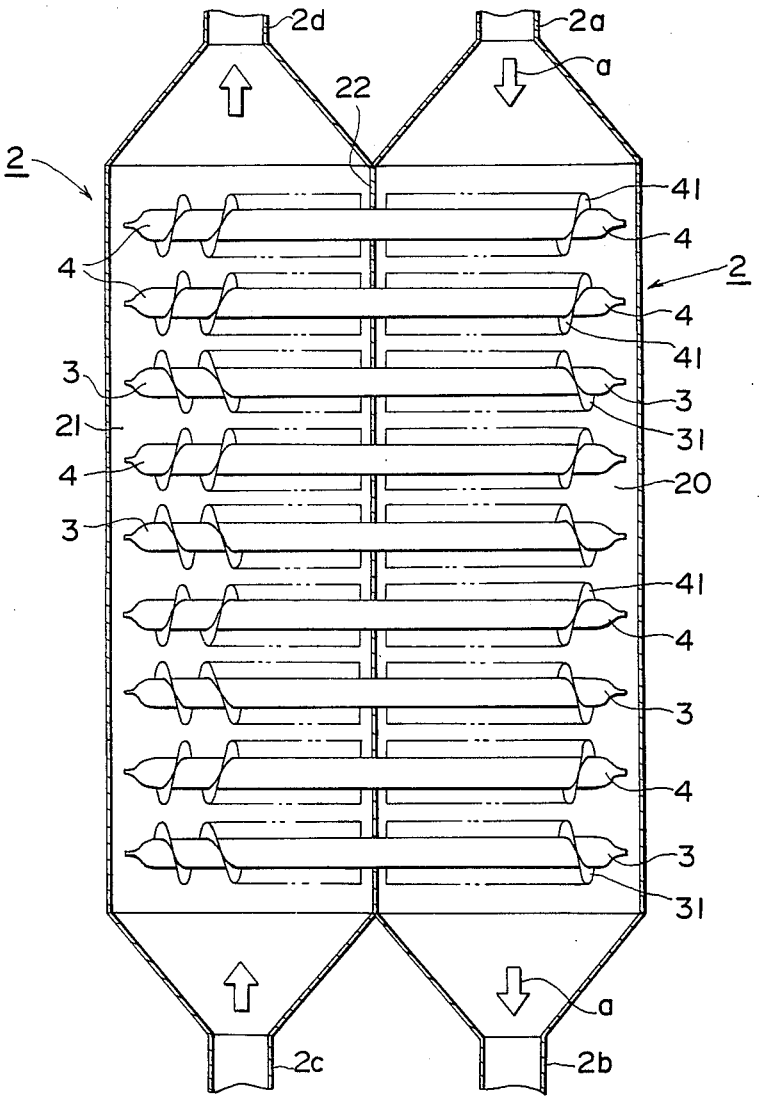
FIG. 4 is a plane view showing another embodiment of the present invention.
Figure 5:
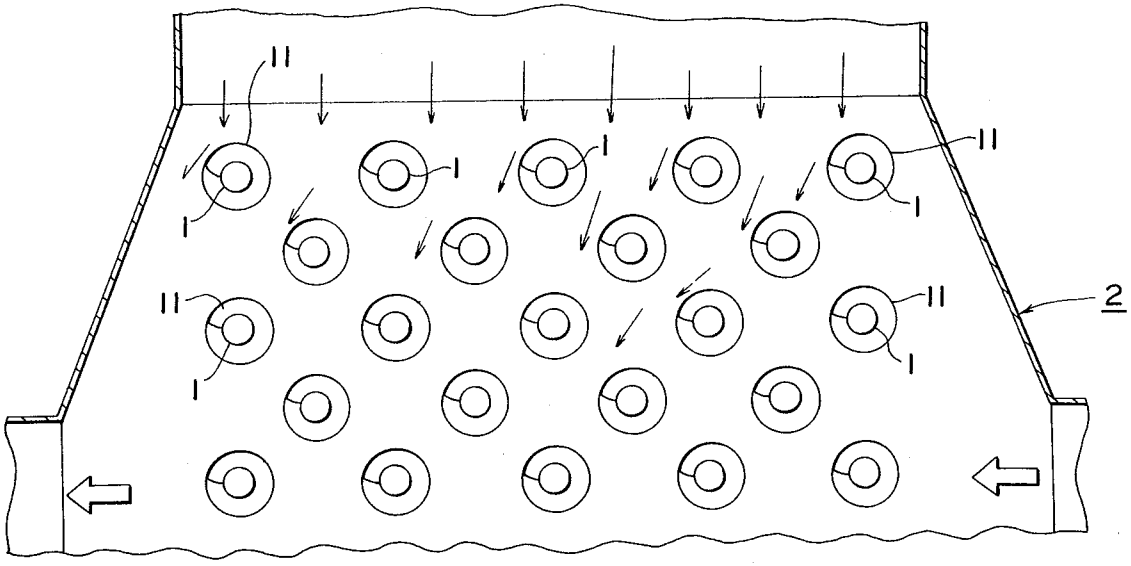
FIG. 5 is a partial sectional view illustrating some problems with the conventional heat pipe heat exchangers.

FIG. 4 shows another embodiment wherein a few (two) rows of the heat pipes 4 with clockwise winding fins 41 are successively arranged at the upper stream along the flow line of the exhausted hot gas as led by an arrow a, and the rest rows by those with differently winding fins alternately to one another. The embodiment as shown in FIG. 4 can attain a better overall cleaning of the heat pipes by having a bunch of the steel balls fall basically onto the heat pipes near the inlet 2a of the exhausted hot ga duct 20 where the most deposition of dust mingled in the exhausted hot gas i present, thus making more steel balls collide with the heat pipes in this area.

Description as to the structure as well as function of the heat exchanger and the attachments as shown in FIG. 4 is omitted since it is as same as that described as to the embodiment shown in FIGS. 1 and 2.

The heat pipe heat exchanger of the present invention can prevent at the shot cleaning process a bias flow of the steel balls and at the same time can secure a control over the flow of the steel balls intentionally biasing to the heat pipes where more deposition of the dust is present by having the heat pipes arranged alternately with spiral fins winding in a different direction, at least with respect to these heat pipes that contact to the exhausted hot gas.

What is claimed is:

1. A heat pipe heat exchanger which comprises a hot gas flow duct, a cold gas flow duct and a plurality of heat pipes each with spiral fins around thereof, the winding direction of which are clockwise around some of the heat pipes and counter-clockwise around some other heat pipes, that are installed in the ducts horizontally a little slanted so that an end of each heat pipe in the hot gas flow duct becomes lower than the other end of the heat pipes.

2. A heat pipe heat exchanger of claim 1, which comprises the heat pipes with the spiral fins winding clockwise and the heat pipes with those winding counter-clockwise in the hot gas flow duct.

3. A heat pipe heat exchanger of claim 2 in which the heat pipes each with the clockwise winding fins and those each with the counter-clockwise winding fins are alternately arranged in vertical direction and/or horizontal direction in the hot gas flow duct.

4. A heat pipe heat exchanger of claim 2 in which the heat pipes each with the clockwise winding fins and those each with the counter-clockwise winding fins are arranged alternately from top to bottom and/or from row to row.

5. A heat pipe heat exchanger of claim 2 in which several rows of the heat pipes exposed to a flow of a relatively hotter gas in the hot gas flow duct are provided with the fins winding in the same direction, and the rest of the rows of heat pipes exposed to a less hot flow are provided with fins winding clockwise and with those winding counter-clockwise alternately.

6. A heat pipe heat exchanger of claim 2 in. which the spiral fins of the heat pipes positioned in the relatively hotter gas flow in the hot gas flow duct are of stainless steel.

7. A heat pipe heat exchanger of claim 2 in which the tube of the heat pipes exposed to a relatively hotter gas flow in the hot gas flow duct are of carbon steel, while those exposed to a relatively less hot gas flow in the hot gas flow duct are of stainless steel.

* * * * *